US005964605A

United States Patent [19]

Heydorn et al.

[11] Patent Number: 5,964,605

[45] Date of Patent: Oct. 12, 1999

[54] CONNECTOR ASSEMBLY WITH EJECTOR

[75] Inventors: Kenneth J. Heydorn, St. Charles; Timothy J. Medema, Algonquin; Ladislav Jurik, Brookfield, all of Ill.

[73] Assignee: MotivePower Investments Limited, Pittsburgh, Pa.

[21] Appl. No.: 08/921,914

[22] Filed: Aug. 27, 1997

[51] Int. Cl.[6] ..... H01R 13/62

[52] U.S. Cl. ..... 439/159; 439/160; 439/157

[58] Field of Search ..... 439/159, 160, 439/152, 372, 157, 155

[56] References Cited

U.S. PATENT DOCUMENTS

| | | | |
|---|---|---|---|
| 939,932 | 11/1909 | Towle | 285/8 |
| 2,051,425 | 8/1936 | Schlums | 439/159 |
| 2,430,011 | 11/1947 | Gillentine | 439/160 |
| 3,008,115 | 11/1961 | Oakes | 439/160 |
| 3,035,243 | 5/1962 | Bowling | 439/160 |
| 3,059,206 | 10/1962 | Williams | 439/157 |
| 3,111,355 | 11/1963 | Samburoff | 439/159 |
| 4,017,136 | 4/1977 | Sasgen | 439/503 |
| 4,214,800 | 7/1980 | Hollyday et al. | 439/160 |
| 4,232,284 | 11/1980 | Phelon et al. | 336/90 |
| 4,372,635 | 2/1983 | Waldschmidt | 459/160 |
| 4,614,015 | 9/1986 | Nagare et al. | 439/152 |
| 4,619,492 | 10/1986 | Corblick | 439/160 |
| 4,784,610 | 11/1988 | Stuart | 439/160 |
| 4,821,392 | 4/1989 | Layland, Jr. | 439/160 |
| 5,069,631 | 12/1991 | Bauer et al. | 439/159 |
| 5,480,314 | 1/1996 | Campbell | 439/159 |
| 5,709,561 | 1/1998 | Cadoret et al. | 439/157 |

FOREIGN PATENT DOCUMENTS

| | | |
|---|---|---|
| 3133073 | 6/1991 | Japan . |

*Primary Examiner*—Paula Bradley
*Assistant Examiner*—Tho D. Ta
*Attorney, Agent, or Firm*—Alan G. Towner; Eckert Seamans Cherin & Mellott, LLC

[57] ABSTRACT

A cable connector housing assembly with an automatic ejector apparatus integral thereto for facilitating disconnection between cable connector housings. A convenient quick-release operating handle is positioned on the connector housing assembly. The handle is used to disconnect the mechanical and electrical connection between first and second electrical connector housings. The connector housing assembly has a novel, pivoting internal cam apparatus which is operatively coupled to the handle, which, when extended, causes the internal cam apparatus to move a captivated V-shaped bar from a first position to a second position, thereby breaking the electrical connection. Internal to the connector housing are rows of locating ribs that facilitate the correct positioning and alignment of the cable end during assembly of the connector. The associated ejector apparatus is positively biased or pre-loaded via compression springs to automatically return to a reactivation position following disconnection of mated connector housings.

8 Claims, 11 Drawing Sheets

CONNECTOR ASSEMBLY WITH EJECTOR

BACKGROUND OF THE INVENTION

The present invention relates to electrical cable connectors for railroad locomotives and transit railroad cars and in particular to a connector housing having an associated ejector mechanism that facilitates easy disconnection of trainline cable connectors associated with the electrical and communications system connections between a railroad locomotive and each trailing locomotive or transit railroad car.

Electrical specifications for equipment used on locomotives (e.g., 72 volt DC throughout all of North America) requires electrical connections between a railroad locomotive and each trailing railroad locomotive or transit railroad car to be accomplished by a standardized 27-pin (or 36-pin) multiple-pronged connector comprising male and female electrical connectors within associated connector housings disposed at opposite ends of suitable electrical cables. These cable assemblies are typically available in various lengths ranging from approximately 5 to 8 feet.

One problem that has arisen is that, over time, dirt and grease accumulate on the exterior surface of each connector housing, making the housing slippery and hard to grasp. Frequently, the connector housings are positioned on railroad locomotives in an overhead location, making disconnection and connection of the cable assemblies awkward and difficult. Should tools be resorted to by railroad personnel, damage to the connector assemblies can occur.

To ensure that electrical connections are properly maintained between a railroad locomotive and each trailing railroad locomotive or transit railroad car, each cable assembly requires a periodic visual inspection by railroad personnel. This visual inspection requires that each end of the cable assembly be disconnected, the cable assembly visually inspected for wear and tear, and replaced if necessary. As has been noted, disconnecting the cable assemblies should be easily and routinely accomplished by railroad personnel, but in actual practice may require a great deal of effort.

Generally, these cable and connector assemblies are constructed from multiple pieces including connector housings, heads, inserts, spacers, contacts, sleeves, wires, etc., and a centrally disposed multi-conductor cable that has a ferrule at each end. During fabrication of the cable assembly, the correct, centrally-disposed positioning and alignment of each cable end in each connector housing is critical for the correct electrical operation of the cable assembly. It would be an advantage not now found in the prior art to have a connector housing of single-piece construction that facilitates disconnection from the railroad electrical and communications system and eases positioning of each cable end within the housing during fabrication of each cable assembly.

Accordingly, a need arises for a connector assembly that can be readily disconnected from its mating connector without resort to tools or extraordinary effort on the part of the railroad personnel.

SUMMARY OF THE INVENTION

The principal object of the present invention is to provide a connector assembly that has ejector apparatus integral thereto that is easy to operate, and that facilitates the easy disconnection of each cable connector associated with the electrical and communications system of a railroad locomotive and each trailing railroad locomotive or transit railroad car.

Another object of the present invention is to provide a connector housing that is used with the electrical and communications system of a railroad locomotive and each trailing railroad locomotive or transit railroad car that readily facilitates the disconnection between connectors in a manner using a reliable eccentric cam mechanism.

In accordance with an illustrative embodiment of the present invention, there is provided a connector assembly comprising first and second mating connector housings, an ejector slidably affixed to the first connector housing, the ejector having a distal portion capable of contacting a surface of the second connector housing and having a range of travel from a first position through a second position such that the distal portion of the ejector contacts the surface of the second connector housing during at least a part of the range of travel, and an actuator operatively coupled to a proximal portion of the ejector, wherein operation of the actuator moves the ejector from a first position to a second position such that with the ejector in the second position, the first and second connector housings are readily separated.

In one form of the invention, the ejector comprises a substantially V-shaped bar member having a substantially concentric cross-section. The actuator may comprise an eccentric cam body operatively coupled to a pivoting handle, the cam body having a first position and a second position, and having a range of camming movement between the first and second positions. The cam body has a first end and a second end opposite thereof, and a continuous surface disposed between the first and second ends and integral thereto, the continuous surface having a recessed area operatively sized to accommodate the ejector and disposed at a predetermined location on the continuous surface, such that the recessed area facilitates the ejector when the cam body is in the first position.

In another aspect of the invention, the first connector housing has at least one ejector guide channel, the ejector guide channel disposed at a predetermined location on an exterior surface of the first connector housing and integral thereto, the ejector guide channel operatively sized to accommodate the ejector. The first connector housing may have at least one protruding lug member, the lug member disposed about a peripheral edge of the first connector housing and integral thereto, the lug member operatively sized and keyed to accommodate a keyed connection to an associated connector.

The first connector housing preferably includes a centrally disposed interior cavity and an interior surface surrounding said interior cavity, the first connector housing having at least one captivation means integral to the first connector housing and disposed at a predetermined location on the interior surface. The first connector housing has a first end and a second end opposite thereof, the first connector housing having a plurality of protruding members disposed at predetermined locations on an interior surface of the housing and integral thereto at the first end thereof, the protruding members operatively sized to accommodate the correct positioning of a cable end for an associated connector.

In yet another aspect of the invention, the ejector is positively biased to automatically return to the first position following the operation of the actuator.

These and other objects and advantages of the present invention will be clarified in the following description of the preferred embodiment in connection with the drawings, the disclosure and the appended claims, wherein like reference numerals represent like elements throughout.

DETAILED DESCRIPTION OF THE INVENTION

In accordance with the present invention, a connector assembly having a novel ejector apparatus integral to its connector housing assembly, that facilitates the ready disconnection of cable connector housings of an electrical system for a railroad locomotive and each railroad car is described. The present invention overcomes the disadvantages of the prior art by utilizing a novel cam actuator to initiate movement of an ejector apparatus from a first position to a second position to readily separate associated connector housings, thereby facilitating the disconnection of the electrical and communications system between a railroad locomotive and each trailing railroad locomotive or transit railroad car. The invention can best be understood with reference to the accompanying drawing figures.

Figure 1:
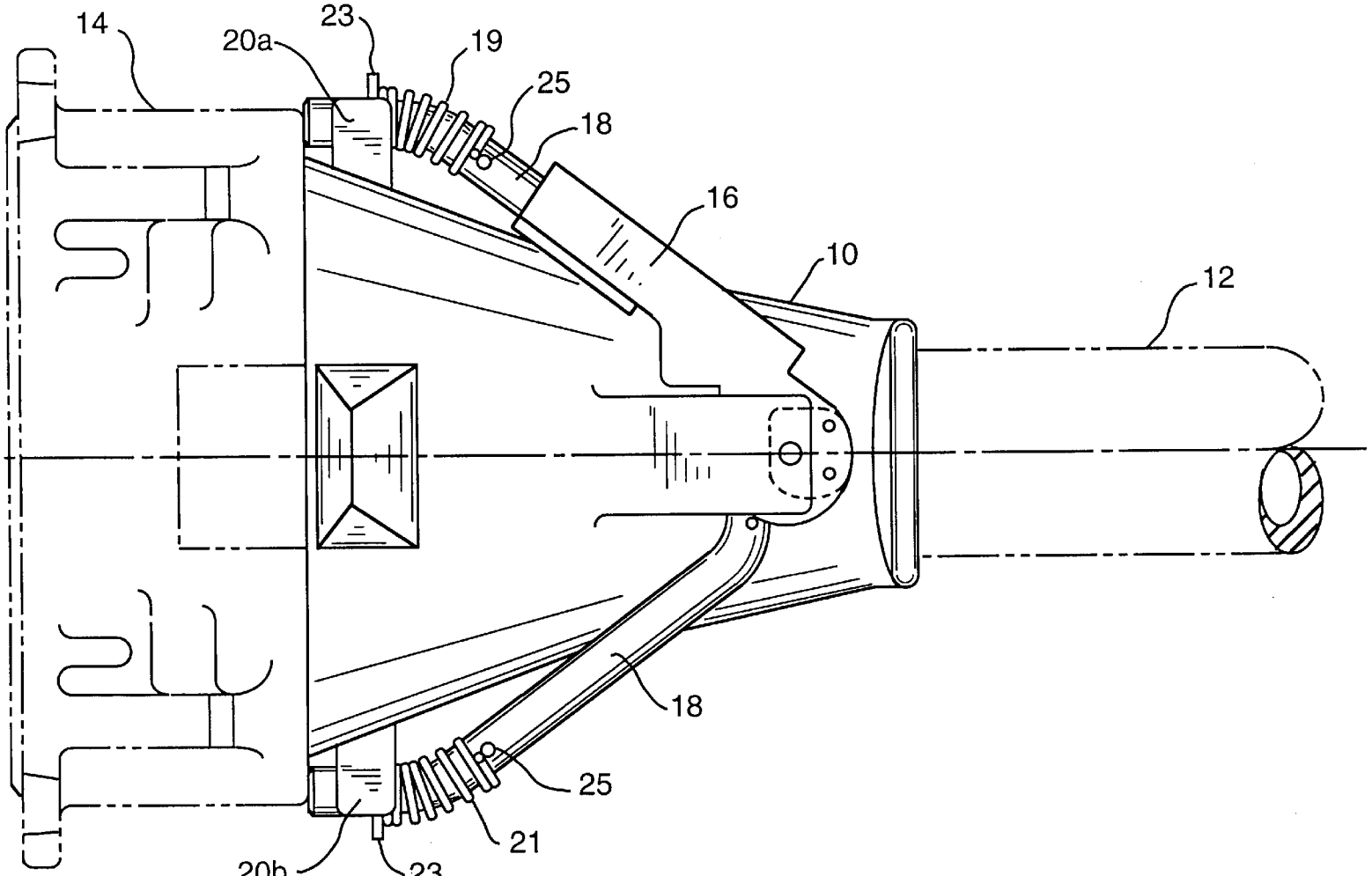
FIG. 1 is a top plan view of a connector housing assembly for use with 27-pin railroad cable connectors of the present invention(with the electrical cable and a receiving electrical receptacle for the cable assembly each depicted in phantom)

Cable connector assemblies facilitate the various electrical connections that are required in the railroad electrical system for a railroad locomotive and each trailing railroad locomotive or transit railroad car. FIG. 1 depicts a connector housing assembly 10 that allows the insertion head to be flat for easy connection to an associated receiving electrical receptacle. The connector housing assembly 10 is reliable, easy to operate, and readily maintained. As has been previously stated, generally the connectors are typically either a 27-pin or a 36-pin configuration and have the following performance specifications: an electrical rating of 600 volts RMS, a dielectric strength of 1,800 volts RMS, and an ambient operating temperature of −30° F. to 110° F.

The connector housing assembly 10 is shown with handle actuator 16 in the closed position and with the connector head fully inserted into a receiving electrical receptacle assembly 14 (but without receptacle cover), as would be the case when the connector is properly used. Note that each end of electrical cable 12 terminates with a ferrule (not shown) which is securely positioned and suitably affixed within the connector housing. Each end of cable 12 terminates in an associated 27-pin cable connector head.

To facilitate disconnection of the connector from the electrical receptacle assembly, the connector housing assembly 10 has a handle actuator 16 that is operatively connected or coupled to release ejector bar 18. The release ejector bar 18 is slidably positioned in respective side guide members or slots 20*a,* 20*b* which are located on the exterior of the connector housing assembly 10. The release ejector bar 18 is free to move within each respective guide member or slot 20*a,* 20*b.* To facilitate the disconnection of the connector requires that the handle actuator 16 be operated. Operation of the handle actuator 16 causes the release ejector bar 18 to move in a forward direction a sufficient distance to initiate or make contact with the receiving electric receptacle 14. As the handle actuator 16 is fully extended, an internal eccentric cam member 22 (see FIG. 4) is caused to travel through a range of camming motion from an initial or first position to a final or second position, which causes the release ejector bar 18 to be moved a further distance, operating to separate the housing assembly 10 from the receptacle 14 as the handle actuator 16 is fully extended. The internal cam member 22 has an associated range of internal camming action or movement from a first position to a second position, thereby causing the release ejector bar 18 to move in a forward direction a predetermined distance. Cam member 22 has a recessed area (see FIG. 4) to receive release ejector bar 18 when the handle actuator 16 is in its initial or closed position.

Each end of release ejector bar 18 has a respective suitably-sized compression spring 19, 21 positioned between a washer 23 and a stop pin 25, and positioned in a manner to facilitate compression as the release ejector bar 18 is moved forward. Accordingly, the springs 19, 21 act to positively bias or otherwise load the release ejector bar 18 during operation of the handle actuator 16 with a sufficient force to automatically return the release ejector bar 18 to its initial position after the handle actuator 16 is returned to its initial position following each operation of the handle actuator 16. Each spring 19, 21 is of a size suitable to facilitate each end of the release ejector bar 18 to pass through the spring approximately at its center. The release ejector bar 18 is of single-piece construction, and preferably formed from steel, aluminum, or a like material. In the preferred embodiment, the release ejector bar 18 has a conical cross-section, although other geometric configurations are also possible.

Figure 2:
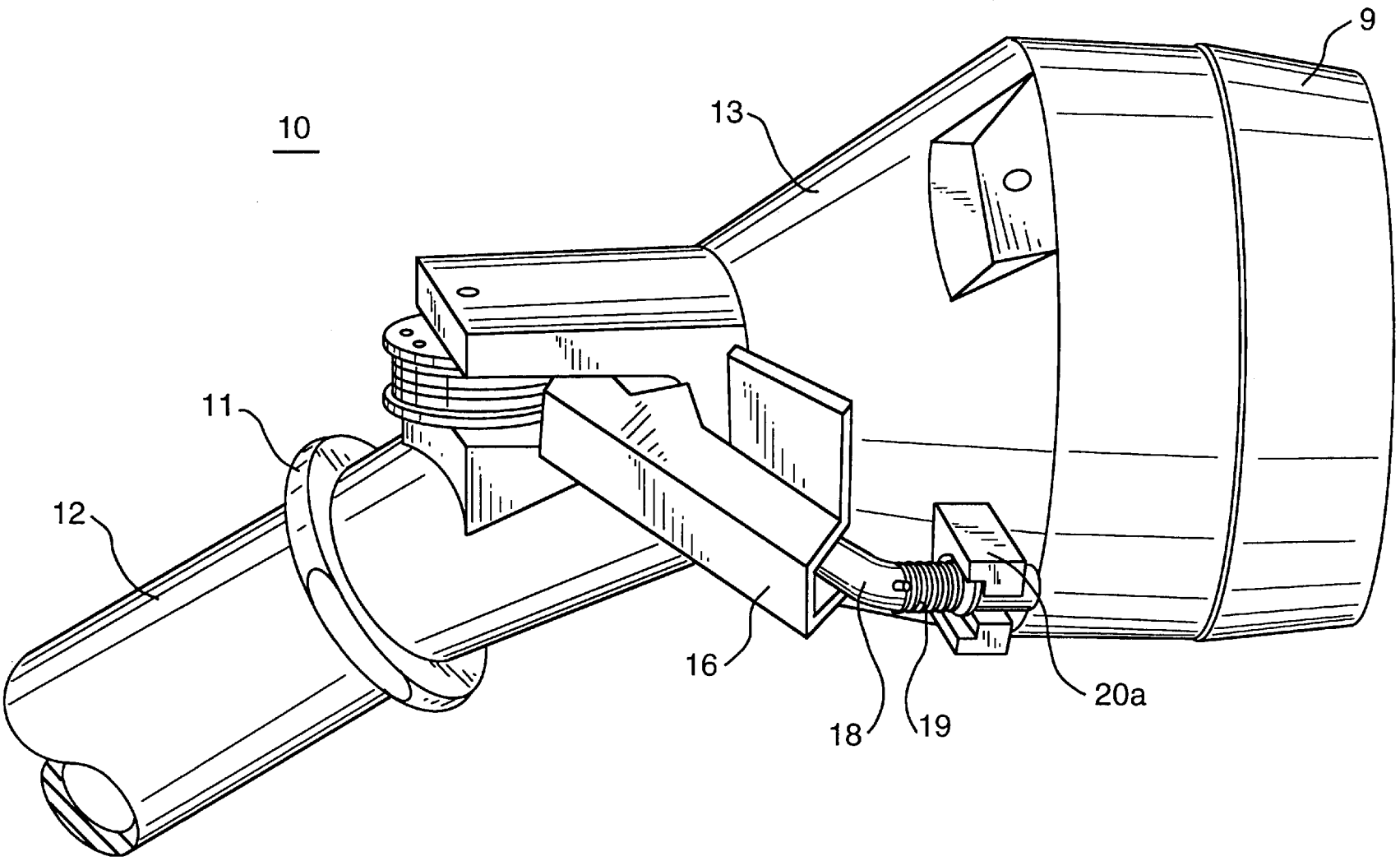
FIG. 2 is a perspective view of a connector housing of the present invention having an automatic ejector apparatus integral thereto.

In FIG. 2, the connector housing assembly 10 has its handle actuator 16 in the closed position, has a raised shoulder portion 11 at its smallest end (which is sized and adapted to receive the electrical cable 12), and a head-end portion 9 at the other or opposite end (which is sized and adapted to receive a 27-pin connector head). The head end 9 is about 5.2 inches in diameter. The connector housing 13 weighs approximately 2.5 pounds and is made of an aluminum alloy (or other synthetic material) in a single-piece construction. Generally, the connector housing 13 is manufactured by conventional sand-casting processes that are old and well-understood by those of ordinary skill in the art. Alternatively, the connector housing 13 may be manufactured by using other techniques, like direct machining operations, die-casting, or injection-molding utilizing high-impact thermoplastic materials that are commercially available, resulting in a connector housing 13 that has a substantially reduced unit manufacturing cost.

Figure 3:
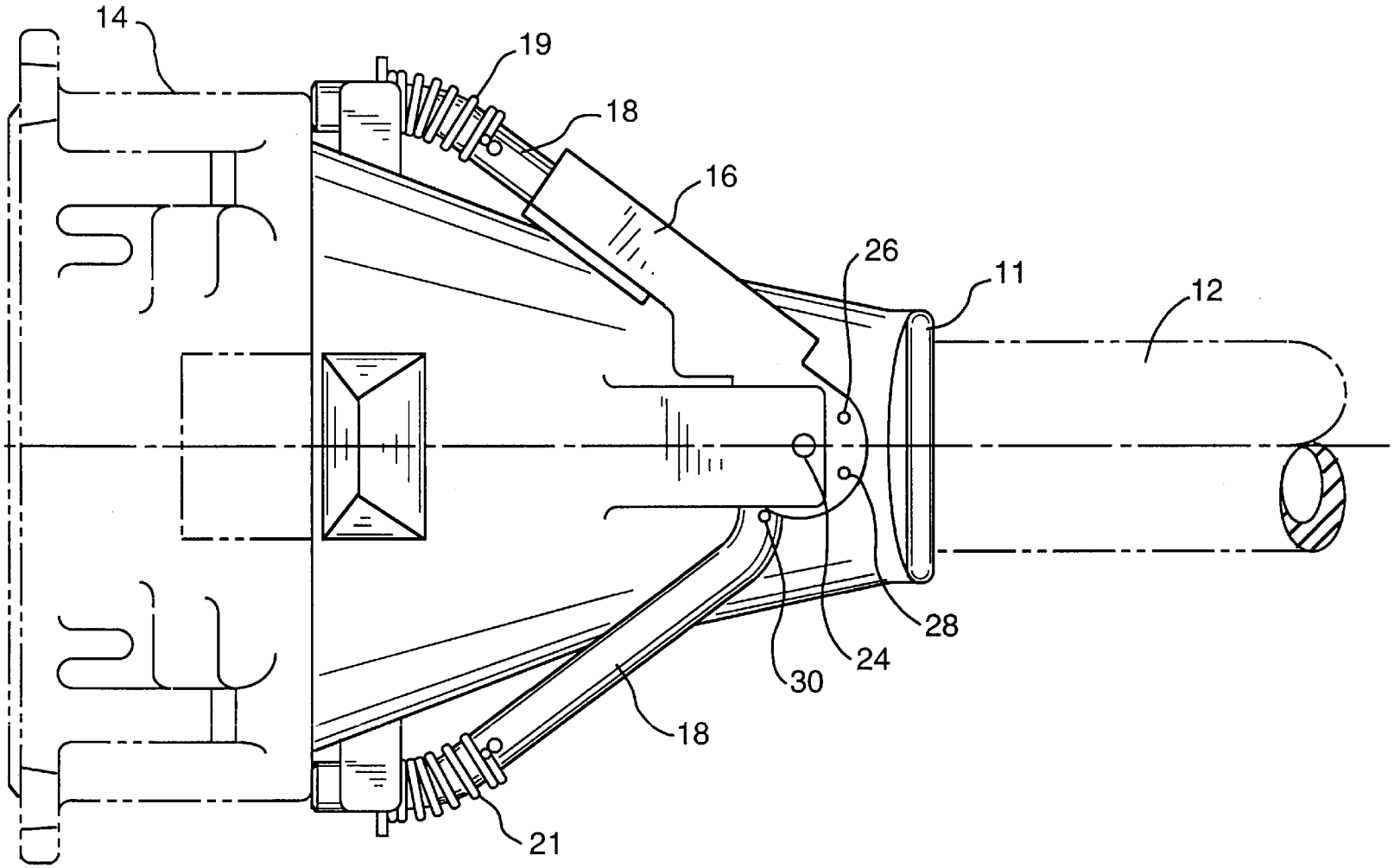
FIG. 3 is a top view of the connector assembly of the present invention with handle actuator in a first or fully closed position and the ejector apparatus not extended.

In FIG. 3, to facilitate the physical disconnection of the connector from the receiving receptacle 14 requires that the handle actuator 16 be operated. Handle actuator 16 is operationally coupled and otherwise affixed to the internal cam member 22 by a centrally-disposed knurl pin 24. During operation of handle actuator 16, stop pin 30 makes certain that handle actuator 16 can be returned only to the original position after each use. The handle actuator 16 is operationally coupled and otherwise affixed to internal cam member 22 (not shown) by two roll pins 26, 28. The handle actuator 16 has a finite and limited range of movement from its closed position to its open position. Internal cam member 22 has a finite and limited range of camming movement from a first position (corresponding to the handle actuator 16 in the closed position) to a second position (corresponding to the handle actuator 16 in the open position). Inasmuch as handle actuator 16 is fixedly and otherwise operationally coupled to internal cam member 22, movement of handle actuator 16 from its closed position to its open position will cause the internal cam member 22 to move from its first position to its second position. Accordingly, since the internal cam member 22 is fixedly and operationally coupled to handle actuator 16 and has a finite and limited range of camming movement, this provides the finite and limited range of movement associated with handle actuator 16.

Figure 4:
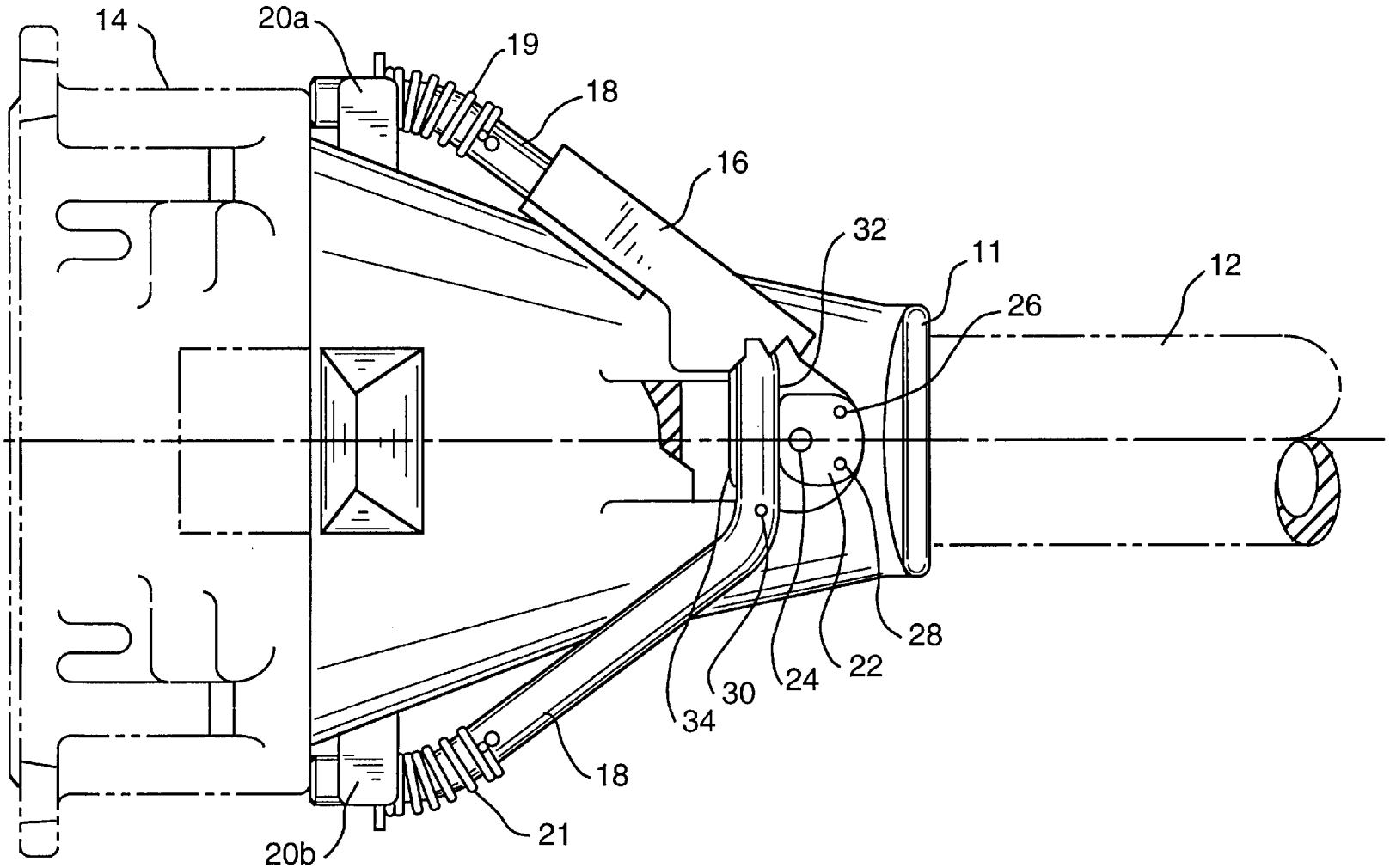
FIG. 4 is a partial or fragmentary isometric view (with part of the handle and exterior housing cut-away) depicting the internal cam apparatus of the connector housing assembly of the present invention.

In FIG. 4, to facilitate the physical disconnection of the connector from the receiving receptacle 15 requires that the handle actuator 16 be operated. Handle actuator 16 for the connector housing assembly 10 is operatively coupled or otherwise fixedly connected to release ejector bar 18 to facilitate the disconnection of the connector housing from the electrical receptacle assembly. The release ejector bar 18 is slidably positioned in respective side guide members or slots 20*a,* 20*b* which are located on the exterior of the connector housing assembly 10. When the handle actuator 16 is operated, the release ejector bar 18 is caused to move in a forward direction by the operation of an internal eccentric cam member 22. Cam member 22 has a range of internal camming action or movement from a first position to a second position, thereby causing the release ejector bar 18 to move in a forward direction. Cam member 22 has a recessed area 32 to receive release ejector bar 18 when the handle actuator 16 is in its initial or closed position. Similarly, connector housing assembly 10 has a generally recessed internal area 34 of sufficient size to facilitate the release ejector bar 18.

Figure 5:
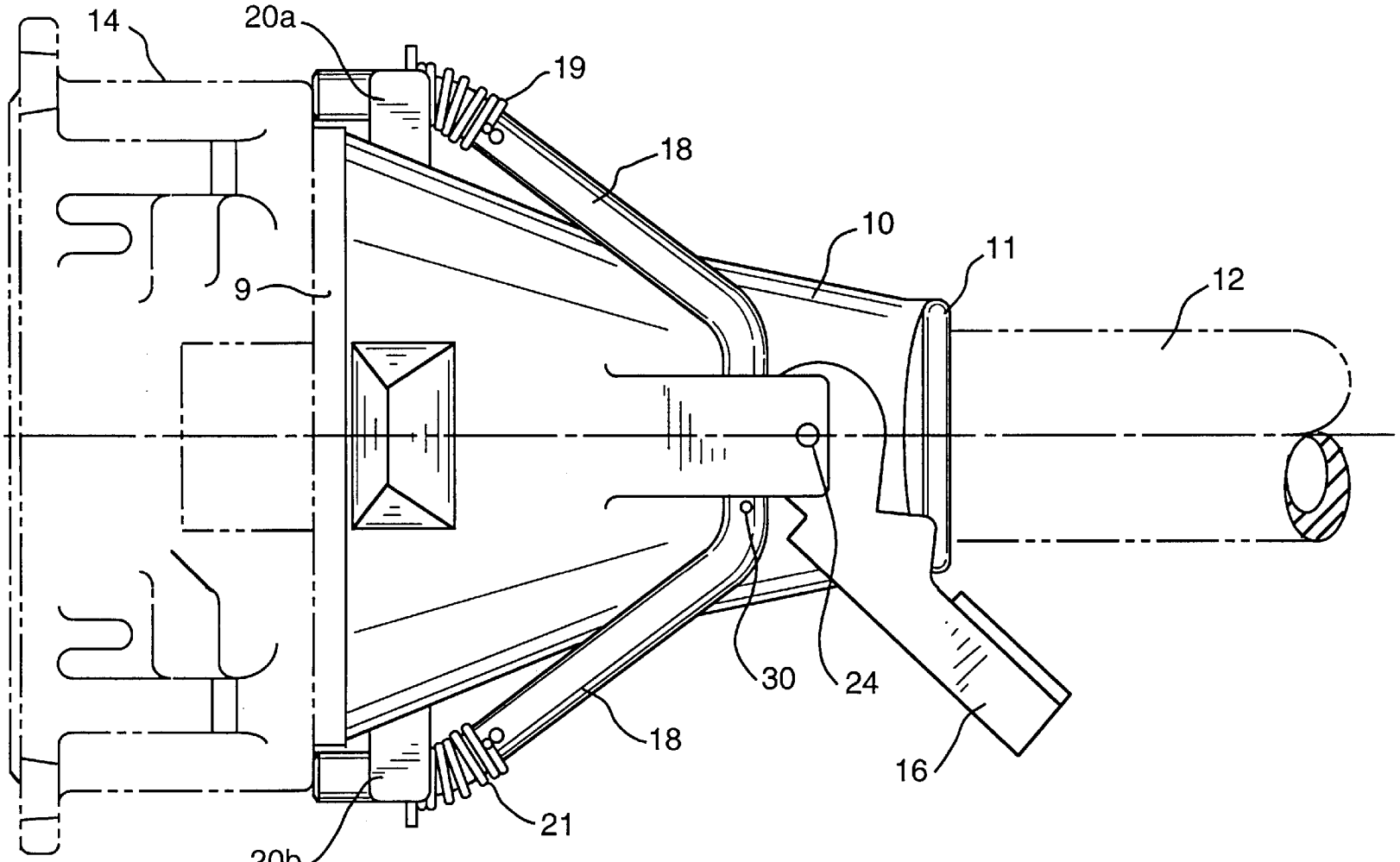
FIG. 5 is a top view of the connector housing assembly of the present invention with handle actuator in a second or open position and the ejector apparatus fully extended (with the electrical cable and the receiving electrical receptacle for the head end of the connector assembly each depicted in phantom)

Mated electrical receptacle 14 (FIG. 5) is caused to be disconnected from the connector housing assembly 10 by the release ejector bar 18 being fully extended, initially making contact with the receptacle 14, and then pushing receptacle 14 away to facilitate the disconnection as the release ejector bar 18 is fully extended. Release ejector bar 18 is operatively connected or coupled to handle actuator 16. As previously mentioned, release ejector bar 18 is slidably positioned in a respective side guide members or slots 20*a,* 20*b* located on the exterior of the connector housing assembly 10. To facilitate the disconnection of the connector requires that the handle actuator 16 be operated, which causes the release ejector bar 18 to move in a forward direction a sufficient distance to make contact with electric receptacle 14 while compressing springs 19, 21.

The connector housing assembly 10 is separated from the receptacle 14 (when the handle actuator 16 is in the fully extended position) by the operation of internal eccentric cam member 22 on release ejector bar 18. Cam member 22 has a range of internal camming action or movement from a first position to a second position, thereby causing release ejector bar 18 to move in a forward direction while simultaneously compressing springs 19, 21 as release ejector bar 18 is pushed forward by cam member 22. During operation of handle actuator 16, recessed area 32 of cam member 22 is caused to pivot away from the release ejector bar 18 thereby causing the release ejector bar to travel from its initial position to its fully extended position and compressing springs 19, 21 to a predetermined load factor, which acts to positively bias the release ejector bar 18.

Thus, when handle actuator 16 is released following usage, and separation of the mated connectors is accomplished, the handle actuator and release ejector bar will automatically be returned to their respective initial positions by operation of springs 19, 21. During operation of handle actuator 16, the recessed area 32 of cam member 22 is caused to pivot away from the release ejector bar 18, causing the release ejector bar 18 to travel from its initial position to its fully extended position this is a sufficient distance to cause the disconnection of the connector from the electrical receptacle 14.

Figure 6:
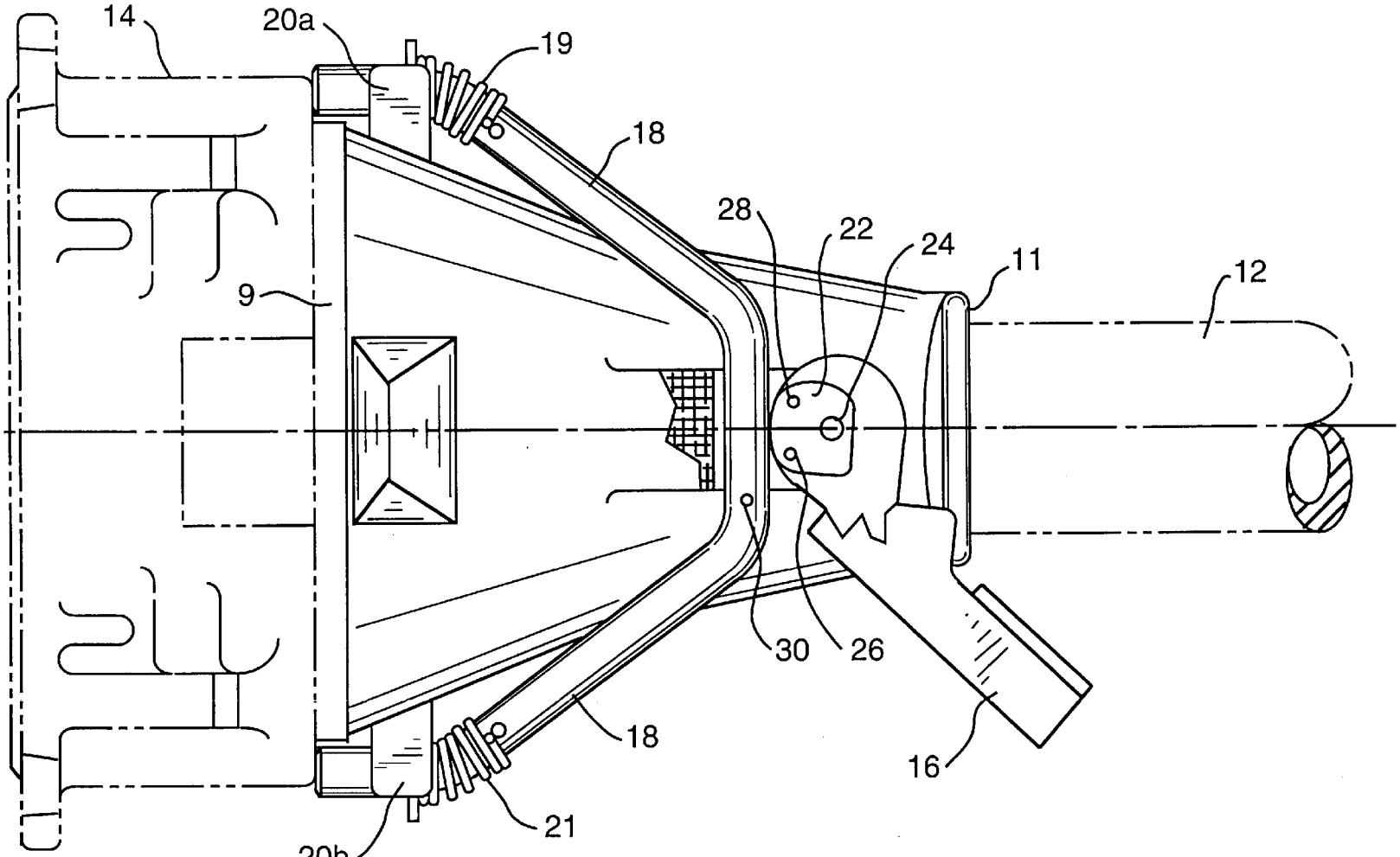
FIG. 6 is a partial or fragmentary isometric view (with part of the handle and exterior housing cut-away) depicting the internal cam apparatus of the connector housing assembly of the present invention.

As previously mentioned, release ejector bar 18 is operatively coupled to the handle actuator 16 (FIG. 6). Release ejector bar 18 is slidably positioned in respective side guide members or slots 20*a,* 20*b* located on the exterior of the connector housing assembly 10. Operation of handle actuator 16 causes the release ejector bar 18 to move in a forward direction, eventually a sufficient distance to make contact with mated electric receptacle 14. As the release ejector bar 18 travels forward, it simultaneously causes springs 19, 21 to compress. Mated electrical receptacle 14 is disconnected from the connector housing assembly 10 by the release ejector bar 18 initially making contact with the electrical receptacle 14. As the release ejector bar 18 is fully extended, it pushes the electrical receptacle 14 away from the connector housing assembly 10, causing the head of the connector to be removed or disconnected from the electrical receptacle 14.

Figure 7:
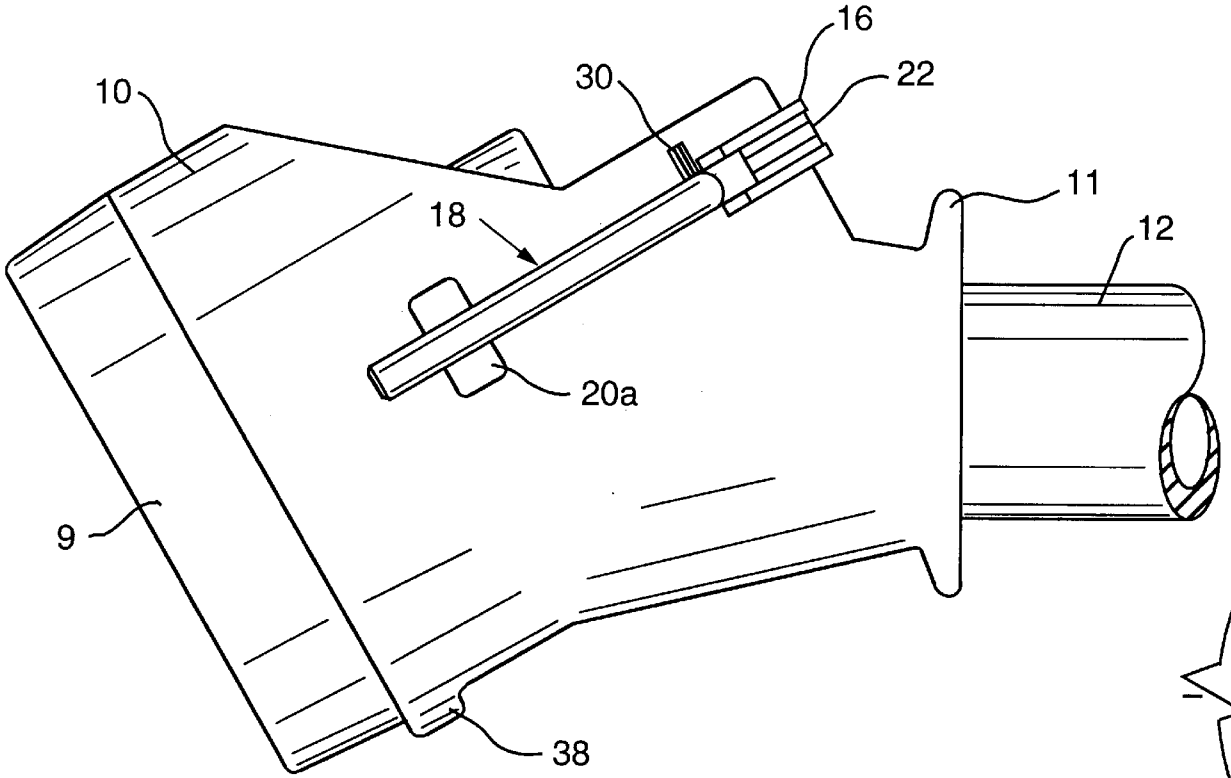
FIG. 7 is a side elevational view of the connector housing assembly of the present invention (with the handle in the closed position and the release ejector bar without springs and in the fully-extended position)

In FIG. 7, the connector housing assembly 10 is tilted slightly to illustrate that the release ejector bar 18 is slidably free in operation with respective guide slots 20*a,* 20*b* (only one of which is depicted). This side elevational view also depicts the fixed positioning of the internal cam 22 within the handle actuator 16.

Figure 8:
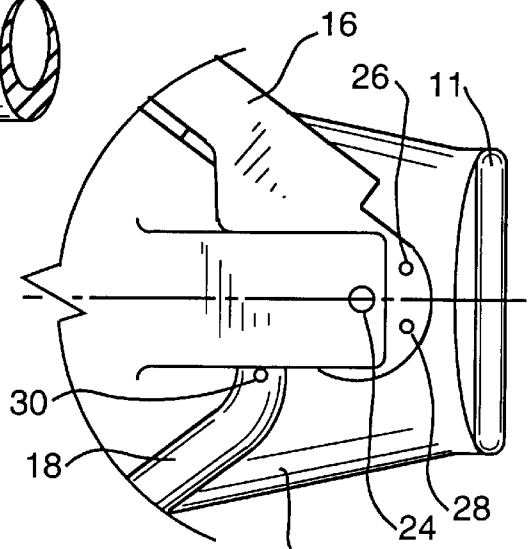
FIG. 8 is a partial or fragmentary top view of the connection of the handle to the cam for the connector housing assembly of the present invention (with the handle in the closed position)

In FIG. 8, knurl pin 24 is press fit into a centrally disposed hole or aperture that is suitably sized, and which extends through the top and bottom of the connector housing assembly 10, internal cam 22 and handle actuator 16. Knurl pin 24 is designed so as not to interfere with the free movement of the handle actuator 16 or with the operation of internal cam 22. Roll pins 26, 28 are positioned in suitably sized respective holes which extend through the internal cam 22 and handle actuator 16, and operationally coupled or otherwise fixedly secured to internal cam 22 and handle actuator 16 in a fixed relation to each, so that operation of the handle actuator 16 through a range of travel from an initial closed position to a fully-extended position will likewise cause the internal cam 22 to travel through a range of camming movement from an initial position to a second position. Stop pin 30 acts to stop the handle actuator 16 from being repositioned past its initial position after the handle actuator 16 is automatically reset following each use.

Figure 9:
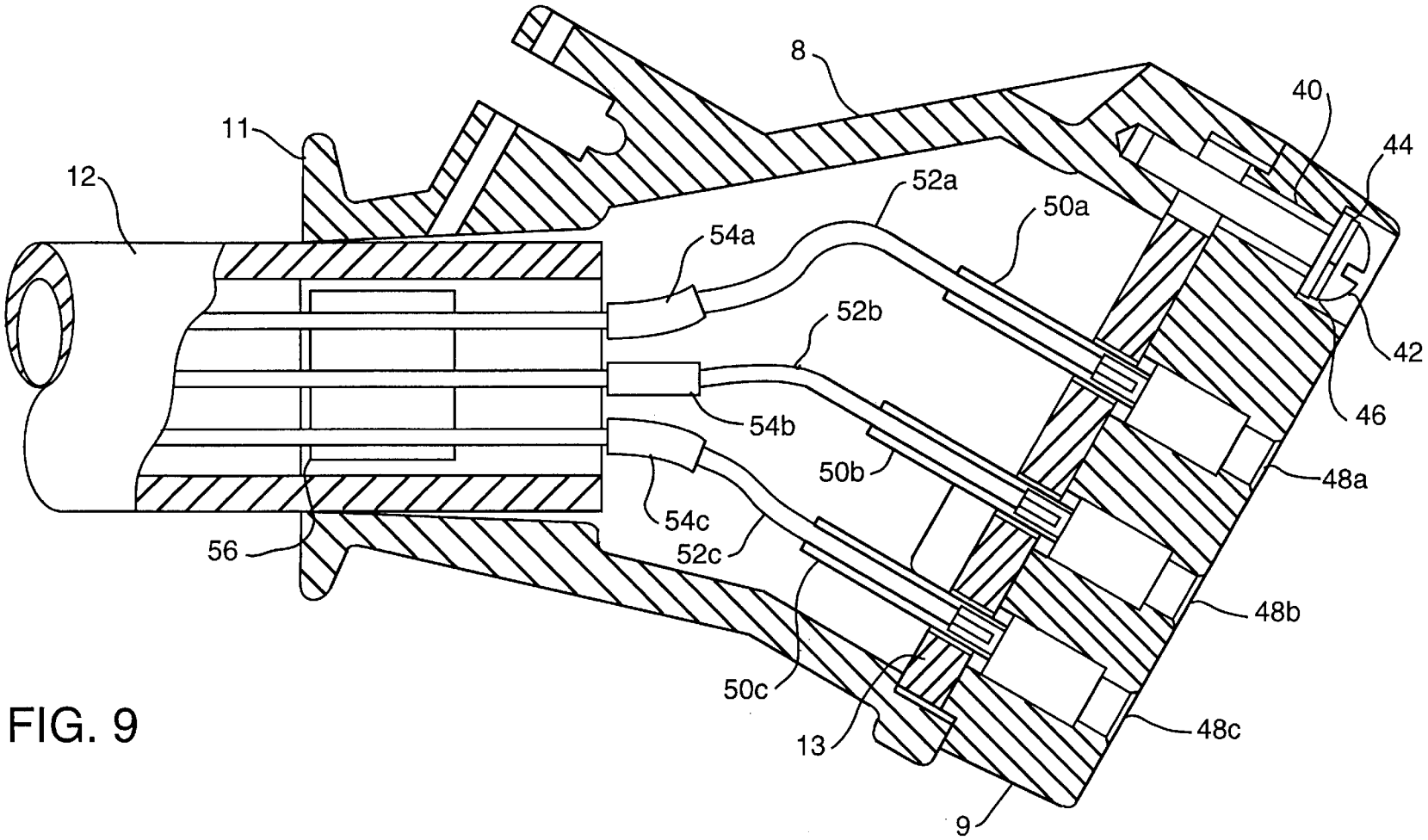
FIG. 9 is a cross-sectional view of the connector housing assembly of the present invention (without the associated automatic ejector apparatus) depicting the internal electrical connections.

FIG. 9 shows that the connector housing 8 has a number of different internal electrical connections. The connector head 9 is tapered and flat for easy insertion into an associated electrical receptacle 14 (not shown). The connector is shown with an associated 27-pin insert 13 attached to the connector head 9. Note that each connector has a universal or standardized insert 13 for either a 27-pin head, or a 36-pin head (or other configuration, if required). To hold the head 9 securely to the connector, internal spacer 40 centrally-disposes or otherwise positions screw 42 in the associated hole extending through the head 9 and into the connector. Suitably sized screw 42 is preferably zinc plated and formed from steel or other suitable material. Flat washer 44 and lock washer 46 secure the screw 42 after tightening. Internal electrical contacts 48*a*, 48*b*, 48*c* facilitate electrical connection with the electrical receptacle 14.

Internal sleeves 50*a*, 50*b*, 50*c* maintain the associated internal electrical wires 52*a*, 52*b*, 52*c* in a correctly spaced relationship with one other. Each electrical wire 52*a*, 52*b*, 52*c* are appropriately tagged with conventional wire tags 54*a*, 54*b*, 54*c*. Wire tags 54*a*, 54*b*, 54*c* are also conventionally referred to as "Brady" type labels by those skilled in the art. Cable 12 has a ferrule 56 at each respective terminating end to help facilitate the correct positioning, alignment and electrical connection of the cable 12 to the connector.

Figure 10:
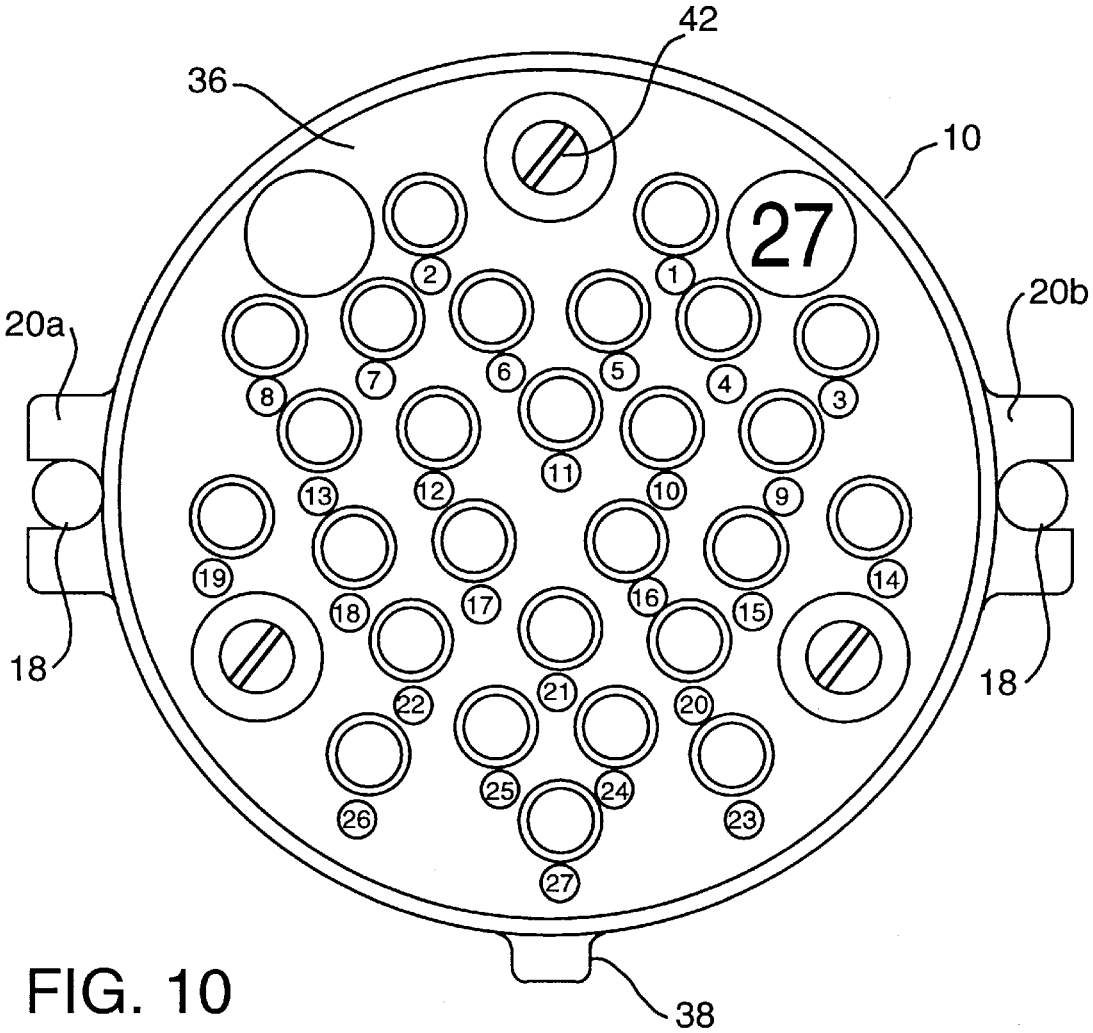
FIG. 10 is a front elevational view of the 27-pin insert for the connector housing assembly of the present invention.

To insure proper alignment and positioning of the connector head end into the receiving electrical receptacle 14, the connector 8 (see FIGS. 9 and 10) has an extending key member 38 that easily fits in a corresponding slot in the electrical receptacle 14. Note that the connector 8 is shown with a 27-pin insert 13 attached to the head of the connector. The associated wiring chart for the connector housing assembly 10 having a 27-pin insert 13 configuration is as follows:

| Socket Nos. | Description | Wire Size |
|---|---|---|
| 1–3 | contacts, sleeves, wires | #14 AWG |
| 4 | contact, sleeve, wire | #10 AWG |
| 5 | contact, sleeve, wire | #14 AWG |
| 6 | contact, sleeve, wire | #12 AWG |
| 7 | contact, sleeve, wire | #14 AWG |
| 8–9 | contacts, sleeves, wires | #12 AWG |
| 10–12 | contacts, sleeves, wires | #14 AWG |
| 13 | contact, sleeve, wire | #12 AWG |
| 14–17 | contacts, sleeves, wires | #14 AWG |
| 18–19 | contacts, sleeves, wires | #12 AWG |
| 20–24 | contacts, sleeves, wires | #14 AWG |
| 25 | contact, sleeve, wire | #12 AWG |
| 26–27 | contact, sleeve, wire | #14 AWG |

The 27-pin head configuration is standardized by the Association of American Railroads and includes the following uniform specifications (from the Manual of Standards and Recommended Practices. Note: this specification is also available for a 36-pin head configuration and is hereby incorporated by reference):

| Receptacle Point | Function | Code | Wire Size (AWG) |
|---|---|---|---|
| 1 | Power Reduction set Up | (PRS) | 14 |
| 2 | Alarm Signal | SG | 14 |
| 3 | Engine Speed | DV | 14 |
| 4 | Negative | N | 12 or 10 |
| 5 | Emergency Sanding | ES | 14 |
| 6 | Generator Field | GF | 12 |
| 7 | Engine Speed | CV | 14 |
| 8 | Forward | FO | 12 |
| 9 | Reverse | RE | 12 |
| 10 | Wheel Slip | WS | 14 |
| 11 | Spare | — | 14 |
| 12 | Engine Speed | BV | 14 |
| 13 | Positive Control | PC | 12 |
| 14 | Spare | — | 14 |
| 15 | Engine Speed | AV | 14 |
| 16 | Engine Run | ER | 14 |
| 17 | Dynamic Brake | B | 14 |
| 18 | Unit Selector Circuit | US | 12 |
| 19 | 2nd Negative, If Used | (NN) | 12 |
| 20 | Brake Warning Light | BW | 14 |
| 21 | Dynamic Brake | BG | 14 |
| 22 | Compressor | CC | 14 |
| 23 | Sanding | SA | 14 |
| 24 | Brake Control/Power Reduction Control | BC/PRC | 14 |
| 25 | Headlight | HL | 12 |
| 26 | Separator Blow-Down/Remote Reset | SV/RR | 14 |
| 27 | Boiler Shut-Down | BS | 14 |

Figure 11:
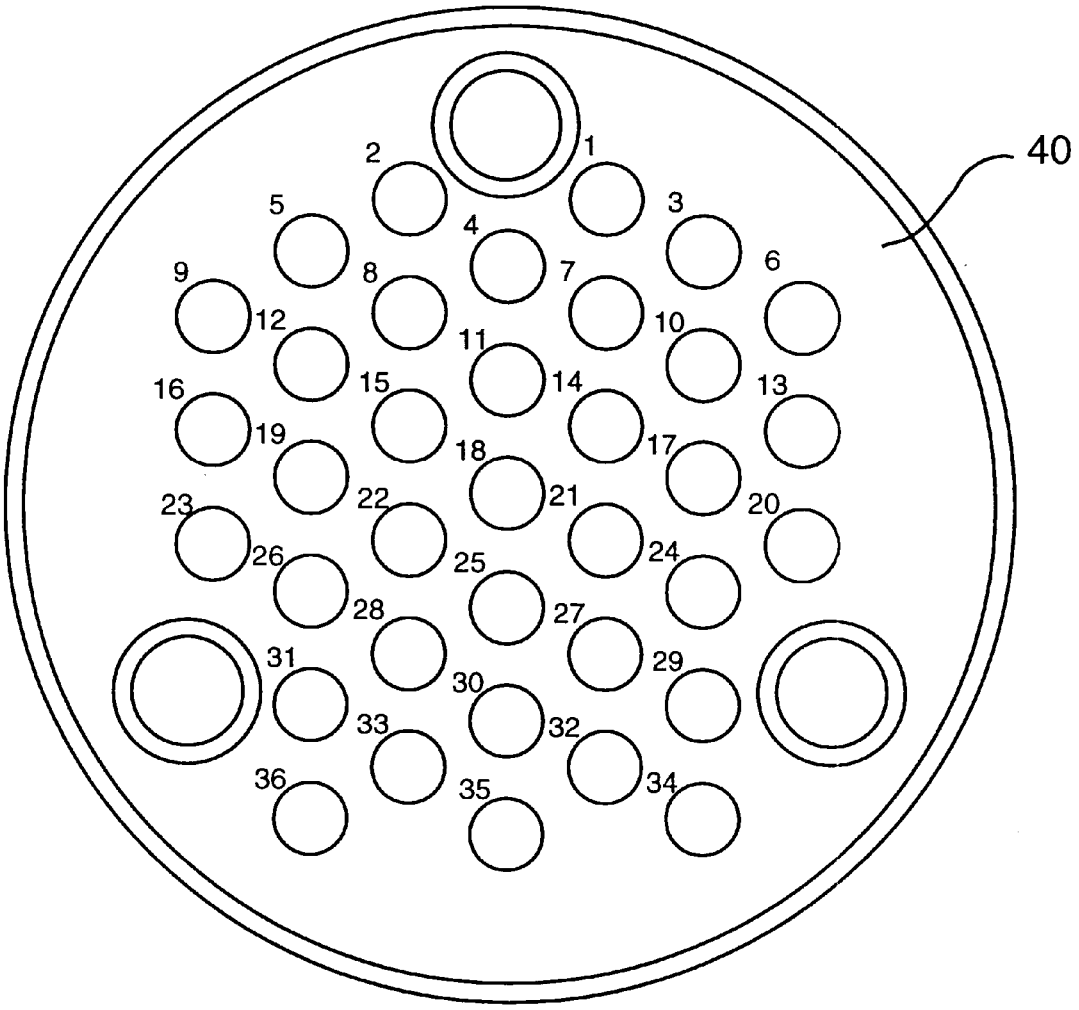
FIG. 11 is a front elevational view of the 36-pin insert for the connector housing assembly of the present invention.

FIG. 11 illustrates the 36-pin insert 40. The same size insert for the connector head is available for any specific pin configuration. A wiring chart is also available for any specific pin configuration.

Figure 12:
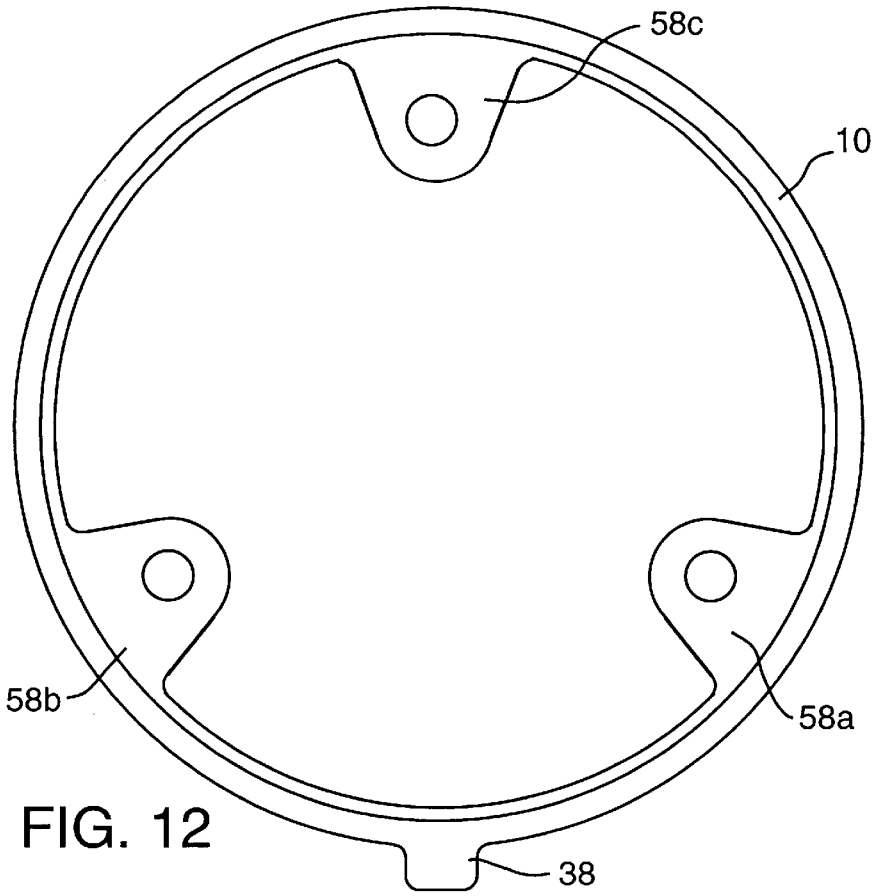
FIG. 12 is a front elevational view of the large end of the connector housing assembly of the present invention.
Figure 13:
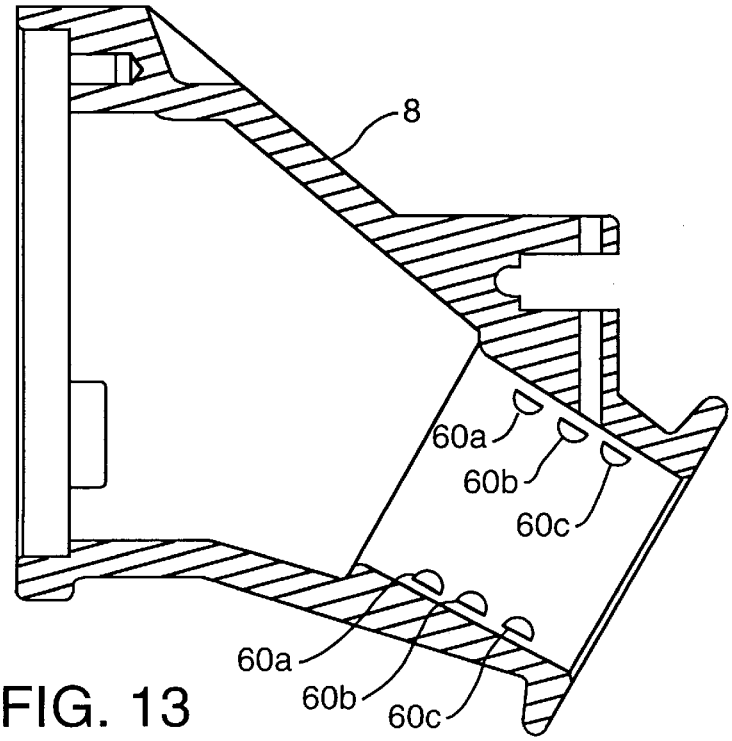
FIG. 13 is a cross-sectional view of the connector housing assembly (without handle actuator or release ejector bar apparatus) depicting the internal rows of protrusions which securely position and align the ferruled end of the electrical cable for the connector housing assembly of the present invention.

The diameter of the large opening depicted in FIG. 12 is about 5.2 inches. The connector housing 8 has internal retention tabs 58*a*, 58*b*, 58*c* located about its circumference on a continuous shoulder or flange. Keyed member 38 extends a predetermined distance and helps facilitate insertion of the connector into a corresponding and complimentary keyed slot of sufficient size (not shown) that is located in the electrical receptacle 14. Internal to the connector housing 8 are upper and lower rows of inwardly extending ribs or protrusions which (FIG. 13) facilitate securing, positioning, and aligning each respective ferruled end of the cable 12 within the connector during assembly.

Although the present invention has been described by reference to a single exemplary embodiment, and the best mode contemplated for carrying out the present invention has been herein shown and described, it will be understood that modifications or variations in the structure and arrangement of this embodiment, other than those specifically set forth herein, may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

What is claimed is:

1. A connector assembly comprising:

first and second mating connector housings separable along a disconnection direction;

an ejector slidably affixed to the first connector housing, said ejector having a distal portion capable of contacting a surface of said second connector housing, and having a range of sliding travel from a first position through a second position in a direction substantially parallel with the disconnection direction of the first and second mating connector housings, such that said distal portion of said ejector contacts said surface of said second connector housing during at least a part of said range of sliding travel; and an actuator operatively coupled to a proximal portion of said ejector, wherein operation of said actuator moves said ejector from a first position to a second position, and wherein said actuator comprises an eccentric cam body operatively coupled to a pivoting handle, said cam body having a cam surface in contact with said proximal portion of said ejector, having a first position and a second position, and having a range of camming movement between said first and second positions, such that with said range of camming movement from its said first position to its said second position causing said ejector to move to its said second position, thereby said first and second connector housings are readily separated.

2. The connector assembly according to claim 1 wherein said ejector comprises a substantially V-shaped bar member, said bar member having a substantially concentric cross-section.

3. The connector assembly according to claim 1 wherein said cam body has a first end and a second end opposite thereof, said cam body having a continuous surface disposed between said first and second ends and integral thereto, said continuous surface having a recessed area operatively sized to accommodate said ejector and disposed at a predetermined location on said continuous surface, such that said recessed area facilitates said ejector when said cam body is in said first position.

4. The connector assembly according to claim 1 wherein said first connector housing has at least one ejector guide channel, said ejector guide channel disposed at a predetermined location on an exterior surface of said first connector housing and integral thereto, said ejector guide channel operatively sized to accommodate said ejector.

5. The connector assembly according to claim 1 wherein said first connector housing has at least one protruding lug member, said lug member disposed about a peripheral edge of said first connector housing and integral thereto, said lug member operatively sized and keyed to accommodate a keyed connection to an associated connector.

6. The connector assembly according to claim 1 wherein said first connector housing has a centrally disposed interior cavity and an interior surface surrounding said interior cavity, said first connector housing having at least one captivation means integral to said first connector housing and disposed at a predetermined location on said interior surface in said interior cavity.

7. The connector assembly according to claim 1, said first connector housing having a first end and a second end opposite thereof, said first connector housing having a plurality of protruding members disposed at predetermined locations on an interior surface of said housing and integral thereto at said first end thereof, said protruding members operatively sized to accommodate the correct positioning of a cable end for an associated connector.

8. The connector assembly according to claim 1 wherein said ejector is positively biased to automatically return to said first position following the operation of said actuator.

* * * * *